US009138764B2

(12) United States Patent
Farrar et al.

(10) Patent No.: US 9,138,764 B2
(45) Date of Patent: Sep. 22, 2015

(54) REFILL LIQUID CONTAINER

(75) Inventors: Peter Antony Farrar, Leeds (GB); John Hein, Leeds (GB)

(73) Assignee: BREEZE PRODUCT DESIGN LIMITED, Leeds (GB)

( * ) Notice: Subject to any disclaimer, the term of this patent is extended or adjusted under 35 U.S.C. 154(b) by 877 days.

(21) Appl. No.: 13/202,013

(22) PCT Filed: Feb. 17, 2010

(86) PCT No.: PCT/GB2010/050265

§ 371 (c)(1),
(2), (4) Date: Aug. 17, 2011

(87) PCT Pub. No.: WO2010/094963

PCT Pub. Date: Aug. 26, 2010

(65) Prior Publication Data

US 2011/0297275 A1 Dec. 8, 2011

(30) Foreign Application Priority Data

Feb. 17, 2009 (GB) ..... 0902626.1
Jun. 17, 2009 (GB) ..... 0910446.4

(51) Int. Cl.
*B65B 1/04* (2006.01)
*B05B 11/00* (2006.01)
(Continued)

(52) U.S. Cl.
CPC ..... *B05B 11/0043* (2013.01); *B05B 11/0048* (2013.01); *B05B 11/0056* (2013.01); *B65D 83/0055* (2013.01); *A45D 34/02* (2013.01); *B05B 11/30* (2013.01)

(58) Field of Classification Search
CPC ..... A45D 34/00; B65B 1/04
USPC ..... 141/2, 6, 22, 23, 113, 156, 157, 330, 141/349; 222/212
See application file for complete search history.

(56) References Cited

U.S. PATENT DOCUMENTS 1,914,791 A * 6/1933 Schmitt et al. ..... 222/209
3,142,319 A * 7/1964 Russo et al. ..... 141/113
(Continued)

FOREIGN PATENT DOCUMENTS

CN 85101324 A 4/1985
EP 126718 A2 * 11/1984 ..... A61J 1/00
(Continued)

*Primary Examiner* — Timothy L Maust
*Assistant Examiner* — Andrew Schmid
(74) *Attorney, Agent, or Firm* — Eric W. Cernyar; James W. Huffman

(57) ABSTRACT

The present invention provides a container system for liquids such as spray fragrances. The system includes a parent container (110) and a child container (120). The parent container provides a first cavity (113) for confining a liquid, and couples detachably to the child container for refilling the child container through a supply opening (111) in the parent container. The child container has a cavity (126) for the liquid, a dispensing mechanism for dispensing liquid, and a valve assembly (124) for filling or topping up liquid into the child container from the parent. The valve (124) opens when the parent container is coupled to the child container. Either the parent or the child container system further includes a movable part (127) which automatically urges liquid from the parent container to the child container, so that when the two containers are together the child container is always full. However, when the child container is separated it can be operated as a self-contained dispenser.

21 Claims, 12 Drawing Sheets

(51) Int. Cl.
*B65D 83/00* (2006.01)
*A45D 34/02* (2006.01)

(56) References Cited

U.S. PATENT DOCUMENTS

| | | | | |
|---|---|---|---|---|
| 3,181,737 | A * | 5/1965 | Chaucer | 222/136 |
| 3,270,525 | A * | 9/1966 | Sellers | 63/1.15 |
| 4,458,830 | A * | 7/1984 | Werding | 222/131 |
| 5,190,190 | A * | 3/1993 | Fudalla | 222/105 |
| 5,292,033 | A * | 3/1994 | Gueret | 222/95 |
| 5,306,125 | A * | 4/1994 | Weag | 417/472 |
| 5,333,761 | A * | 8/1994 | Davis et al. | 222/212 |
| 5,417,258 | A * | 5/1995 | Privas | 141/18 |
| 5,462,099 | A * | 10/1995 | Demarest et al. | 141/3 |
| 5,524,680 | A * | 6/1996 | de Laforcade | 141/18 |
| 5,623,974 | A * | 4/1997 | Losenno et al. | 141/20 |
| 5,871,126 | A * | 2/1999 | Bennett et al. | 222/207 |
| 6,062,437 | A * | 5/2000 | Mascitelli | 222/212 |
| 6,196,276 | B1 * | 3/2001 | De Laforcade | 141/20 |
| 6,435,231 | B1 * | 8/2002 | Cooper et al. | 141/346 |
| 6,607,012 | B2 * | 8/2003 | Yquel | 141/20 |
| 6,997,219 | B2 * | 2/2006 | Py et al. | 141/314 |
| 7,665,635 | B2 * | 2/2010 | Ramet et al. | 222/321.7 |
| 8,596,501 | B2 * | 12/2013 | Hagleitner | 222/207 |
| 8,662,116 | B2 * | 3/2014 | Dumont et al. | 141/113 |
| 8,695,896 | B2 * | 4/2014 | Tu | 239/333 |
| 8,739,839 | B2 * | 6/2014 | Muller | 141/18 |
| 2002/0057938 | A1 | 5/2002 | Gueret | |
| 2005/0016622 | A1 * | 1/2005 | Risch et al. | 141/113 |
| 2005/0284891 | A1 | 12/2005 | Ramet et al. | |
| 2008/0251541 | A1 * | 10/2008 | Cornet et al. | 222/209 |
| 2009/0194191 | A1 * | 8/2009 | Turgeman | 141/18 |
| 2009/0208813 | A1 | 8/2009 | Hasebe et al. | |
| 2010/0032451 | A1 * | 2/2010 | Neuhaus et al. | 222/207 |
| 2010/0310426 | A1 * | 12/2010 | Campbell et al. | 422/100 |
| 2011/0061764 | A1 * | 3/2011 | Springer | 141/1 |
| 2011/0297275 | A1 * | 12/2011 | Farrar et al. | 141/113 |
| 2012/0103926 | A1 * | 5/2012 | Ibsies | 215/228 |
| 2013/0269830 | A1 * | 10/2013 | Farrar et al. | 141/27 |
| 2014/0137983 | A1 * | 5/2014 | Tu | 141/113 |

FOREIGN PATENT DOCUMENTS

| | | | | |
|---|---|---|---|---|
| FR | 2630712 | A1 * | 11/1989 | B65D 47/28 |
| FR | 2802447 | A1 | 6/2001 | |
| FR | 2802447 | A1 * | 6/2001 | B05B 11/02 |
| FR | 2904613 | A1 | 2/2008 | |
| JP | 04-046074 | | 2/1992 | |
| JP | 10-101115 | | 4/1998 | |
| WO | WO 9726997 | A1 * | 7/1997 | B05B 11/00 |
| WO | WO 2005/101969 | A2 | 11/2005 | |

* cited by examiner

100

100

110

200

210

220

REFILL LIQUID CONTAINER

This application is a national stage application of International patent application no. PCT/GB2009/050265, filed Feb. 17, 2010. This application also claims priority to Great Britain Patent Application Nos. 0902626.1, filed Feb. 17, 2009, and 0910446.4, filed Jun. 17, 2009.

The present invention relates to a liquid container, in particular to a liquid container system with a dispensing mechanism, and to a liquid dispensing system and method of using the liquid container.

Conventionally, many liquid products, for example perfume, liquid soap, moisturiser, etc., are sold in containers equipped with a delivery mechanism that dispense a controlled amount of the content of the containers, the most common being a pump mechanism which, when pressed, delivers the product in its original liquid form, or in the form of mist or foam. The design of the container and delivery mechanism is central to such a product, as the aesthetics of the container often draw in custom, and a well-designed dispensing system not only adds to the aesthetics of the product, but ensures that the optimal amount of the liquid content is delivered to the user in a desirable form.

However, it is often inconvenient for the user to transport a liquid product in its "standard pack" container when travelling, for overnight stays, or, especially for perfume and aftershave, carry the product in handbags or briefcases. In some cases, it would even be impossible for the user to transport a product in its standard pack, for example because of restrictions imposed on hand baggage for air travellers.

The user often resorts to transferring an amount of the liquid product from its original container to a smaller container, which is an inconvenience to the user, and often results in spillage or contamination. For some products, it may not be possible for the user to transfer the content from the original container to another container, for example if the original container is sealed and the content is to be dispensed as mist or foam.

Manufacturers of liquid products may provide the products in smaller "travel packs", but it may not be cost-effective to incorporate the same delivery mechanism used in a standard pack into the smaller, and so necessarily cheaper, travel pack.

The discrepancy of delivery mechanism between the standard pack and the travel pack of a product is undesirable for the manufacturers, especially for luxury brand products for which packaging is an important aspect of the product. Moreover, travel packs by design are not intended for long-term use, and so are wasteful of resources.

U.S. Pat. No. 7,066,674 (L'Oreal) discloses a device for applying a liquid product, comprising a receptacle for containing the liquid, and a removable unit configured to be removably positioned on the receptacle. An application element (such as a sponge or a felt) for applying the liquid is housed within the removable unit. When the removable unit is positioned on the receptacle, the application element can be loaded with the liquid from the receptacle by actuating a suitable mechanism such as a pump.

However, the removable unit of the device of U.S. Pat. No. 7,066,674 is only able to retain a small amount of the liquid product limited by the application element. Thus, as described therein, the removable unit is only capable of a few applications. Moreover, after the application element is loaded, the liquid will inevitably evaporate, and a user may find him/herself in situations where the removable unit is removed and taken away for later application without the user realising that the liquid product has evaporated or the application element has not been loaded. Also, designs of this kind do not solve the problem of incorporating a dispensing unit, such as a spray, in a travel fixture.

It is therefore desirable to provide a liquid container that can accommodate travel requirements, while minimising wastage of resources and preserving the consistency of products, which is simple and convenient to use.

The present invention provides a two-part liquid container system that comprises a parent container for containing the main reservoir of liquid and a refillable child container for containing and dispensing liquid, which can be attached to the parent container for normal use, drawing liquid from the parent container, or for refilling, and can be detached from it for easy transport.

In one aspect, the present invention provides a container system for liquids, including a parent container and a child container; the parent container provides a first cavity for confining a liquid, and is configured to couple detachably to the child container for refilling the child container through a supply opening in the parent container. The child container provides a second cavity for confining a liquid, and comprises a dispensing mechanism for dispensing liquid from the second cavity through a dispense opening, and a fluid transfer assembly, preferably including a valve assembly, for controlling liquid flow from the parent container into the child container through a refill opening. The first valve assembly is configured to form a channel between the first cavity and the second cavity to allow liquid flow when the parent container is coupled to the child container. The container system further includes a movable part which, in one direction of travel, urges liquid from the parent container to the child container, coupling of the child container to the parent container leading to movement of the movable part so as to cause an amount of liquid to pass from the first cavity into the second cavity, ensuring that the child container is filled when connected to the parent container.

The moving part may be implemented in the child container, which preferably further comprises a restoring means that stores a restoring force as liquid is expelled from the second cavity by the dispensing mechanism. When the child container is separated from the parent container, dispensing of liquid causes the second cavity to contract, the moving part being connected to, or forming part of the wall of, the second cavity. When the parent container and the child container are coupled together again, the restoring means releases the restoring force so as to expand the second cavity to the original state, urging the moving part back to its initial position, thereby drawing liquid from the first cavity into the second cavity.

Alternatively, the moving part may be implemented in the parent container, which further comprises an actuator assembly that pressurises the first cavity through the action of coupling the parent container and the child container, coupling of the parent container with the child container engaging the actuator assembly and driving liquid from the first cavity into the second cavity.

With the invention a travel or "child" container can thus be recharged a large number of times from a "parent" container containing liquid at atmospheric pressure. Moreover, this happens automatically whenever the two are coupled together. Meanwhile, the coupled container system can be used as a unit in the familiar way.

For a better understanding of the present invention, various examples will now be explained with reference to the accompanying drawings, in which.

Figure 1A:
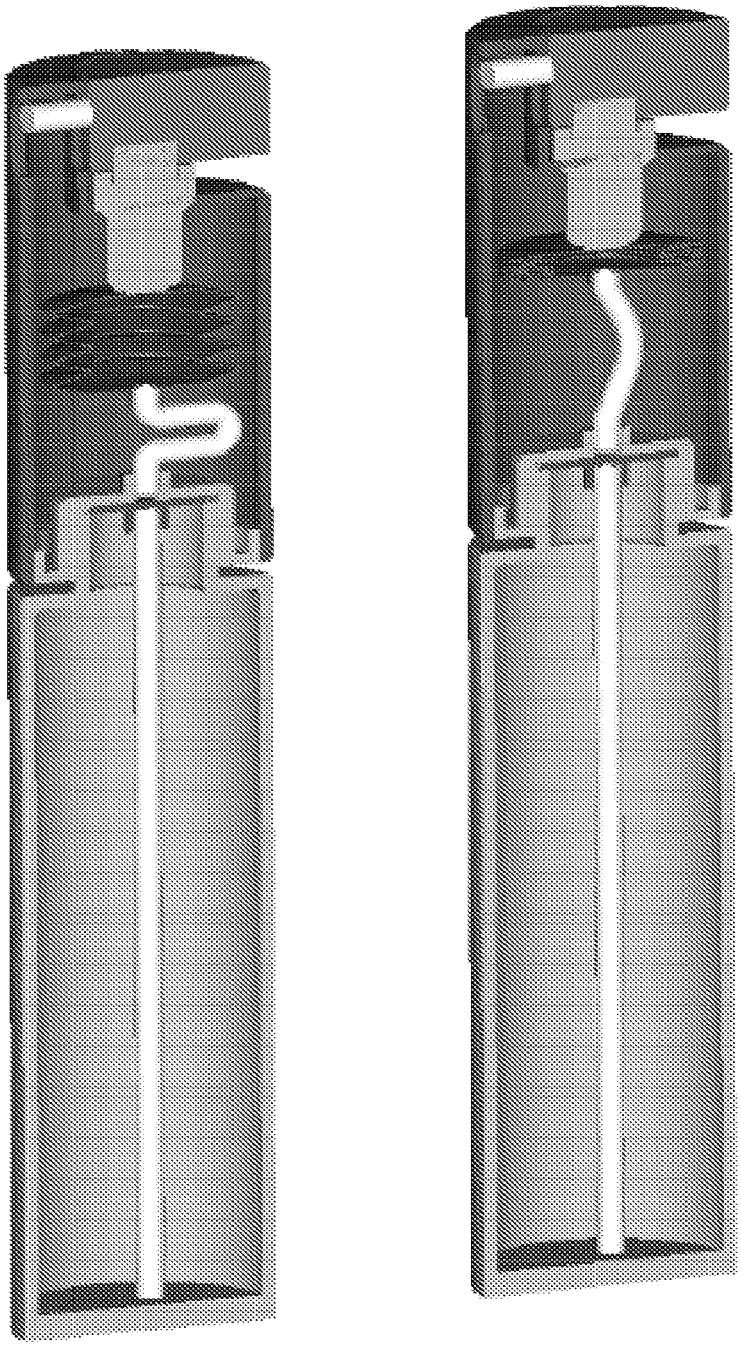
FIG. 1A shows a container system representing a first embodiment of the present invention.
Figure 1B:
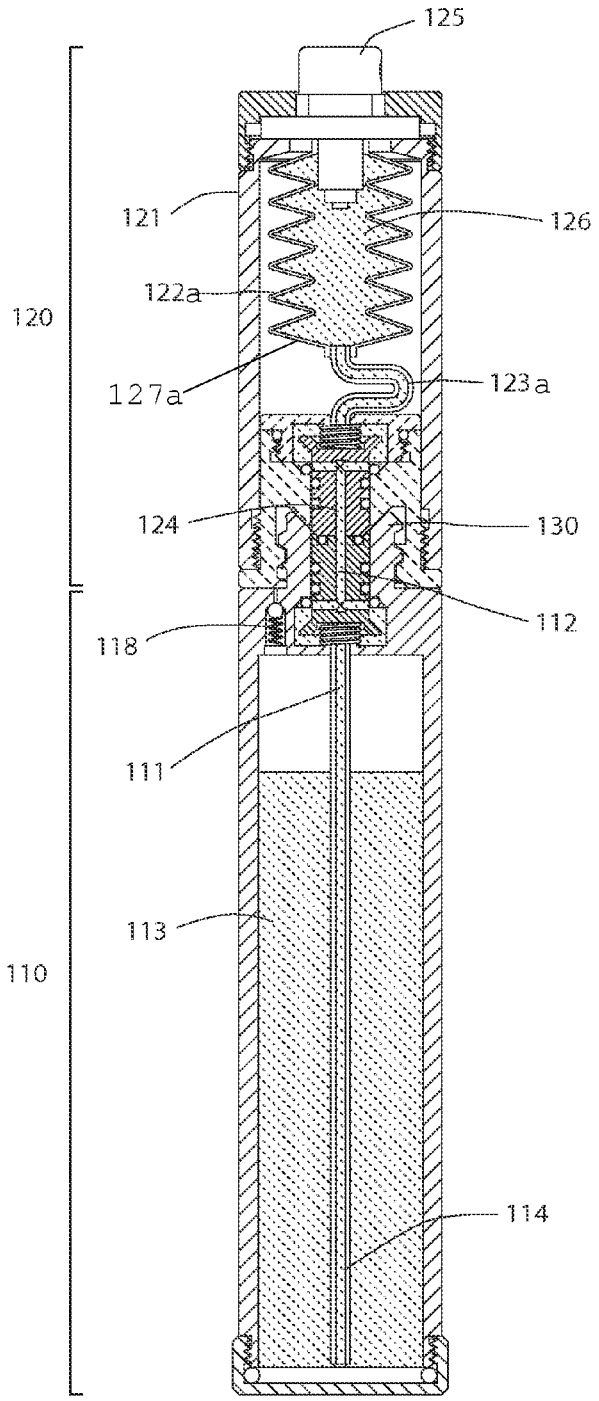
FIG. 1B shows a line drawing of the container system of FIG. 1A.

A first embodiment of the present invention is shown in FIGS. 1A and 1B as a bottle (liquid container system) 100, comprising a main body (parent container) 110, which can be made of glass, plastic or any suitable material, and a refillable cap portion (child container) 120, which is detachably secured to the main body 110 by means of a securing mechanism 130, here a screw thread, though it could also be, say, a bayonet or clip-on mechanism.

Figure 2:
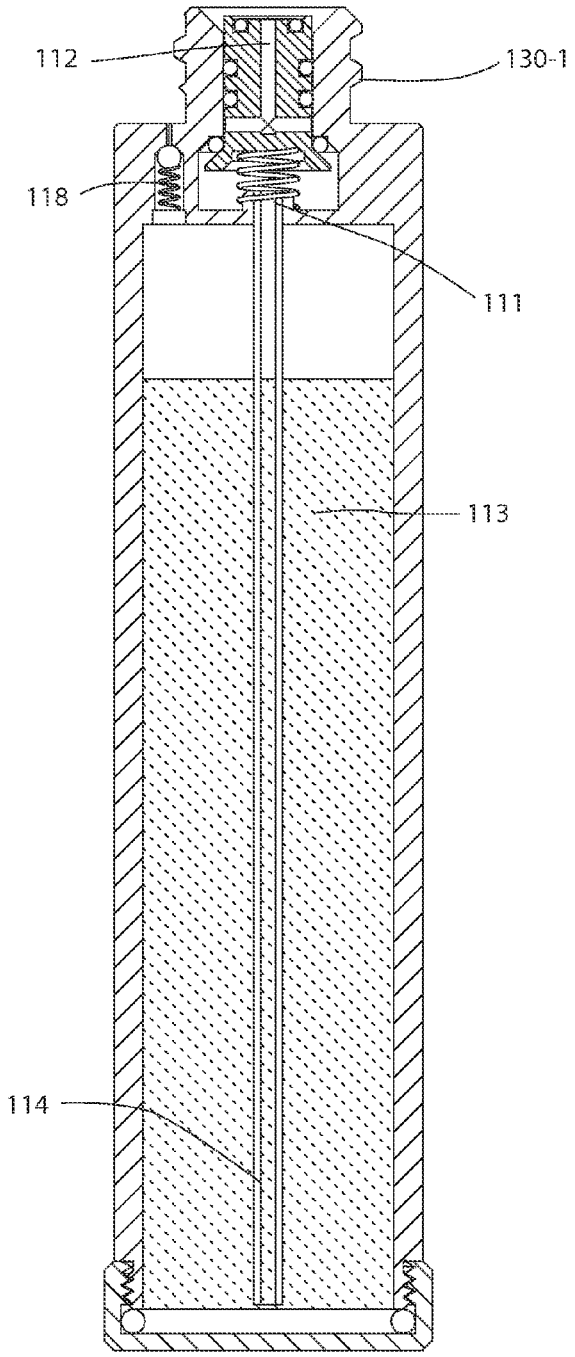
FIG. 2 shows the main body of the container system of FIG. 1B.

The main body 110, shown in its isolated state in FIG. 2, has an opening (supply opening) 111, which is occupied by or coupled to a valve 112. When the main body 110 is separated from the cap portion 120 the valve 112 is closed, providing a sealed cavity 113 for confining a liquid therein. The cavity 113 holds a tube 114, which extends from the supply opening towards the bottom of the cavity 113, for extracting the liquid content from the cavity 113 through the tube 114. Air flow into the main body 110 is controlled by a one-way valve 118. The sealing valve 112 and the tube 114 form a valve assembly providing a passage from the cavity 113 to outside the main body 110 through the valve 112.

Figure 3:
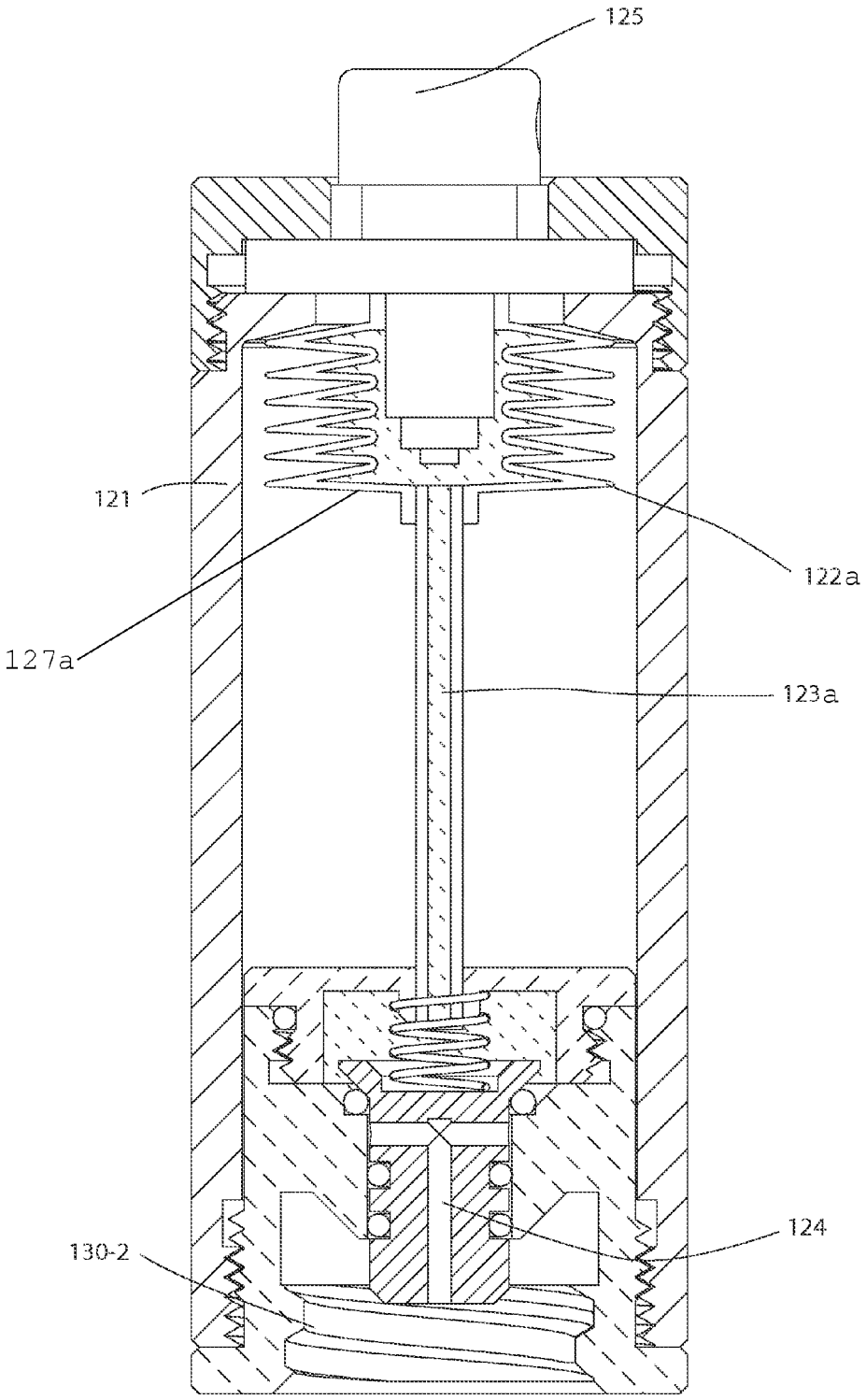
FIG. 3 shows the cap portion of the container system of FIG. 1B.

The cap portion 120, shown separated in FIG. 3, comprises a casing 121, which is typically metal or plastic. The casing 121 is in several parts, secured together, and provides a support structure for mounting the components of the cap portion 120 and can be in any shape or form. In particular, it can be designed in the same style as a simple cap for a main container having a spray head.

Within the casing 121, the cap portion 120 contains a collapsible container in the form of a bellows 122*a*. The bellows forms a collapsible chamber or compartment that can be expanded to draw in fluid through a valve and contracted to expel it through a suitable outlet such as a spray dispenser. The bellows 122*a* has two openings, the lower one of which (the refill opening) located in the bottom wall 127*a* of the bellows and is coupled to a flexible tube 123*a*, which extends into a valve 124, located in the lower part of the casing 121. This part also has a screw thread for 130-2 for attaching the casing 121 to the main body 110. The tube 123*a* and the valve 124 form a valve assembly providing a sealed passage from the bellows 122*a* to outside the cap portion 120 through the valve 124.

The upper opening (the dispense opening) of the bellows 122*a* is coupled to a pump mechanism 125, thus creating a sealed cavity 126 inside the bellows 122*a*, in which a liquid can be confined. When the pump mechanism 125 is actuated, the content of the bellows 122*a* is expelled through the opening, in this case as a mist.

Initially the bellows is in a filled state with liquid in the cavity 126, as shown in FIG. 1B. The cap portion 120 can then be detached, whereupon the valve 124 seals. Since the bellows 122*a*, the valve assembly 123*a* and 124 and the pump mechanism 125 form a sealed system, when liquid is expelled from the cavity 126 by the action of the pump mechanism 125, the decrease in the volume of liquid causes the bottom 127*a* of the bellows 122*a* to be pushed upwards into the cavity 126 under atmospheric pressure, thus causing the bellows 122*a* to collapse. As the bellows collapses, an expansion force is built up in the bellows 122*a* as it is being compressed.

When it is desirable to refill the cap portion 120, or simply convenient to use the cap portion 120 and the main body 110 as a single combined unit, the cap portion 120 is placed onto the main body 110, and screwed into position by the securing mechanism 130. When the cap portion 120 is in position, the valve 112 of the main body 110 and the valve 124 of the cap portion 120 push against each other and force the valve bodies to retreat into the respective cavities, thus opening up a channel from the cavity 113 of the main body 110 into the cavity 126 of the bellows 122*a*. This channel is sealed by various O-rings as shown.

As a result of the valve 124 of the cap portion 120 being opened, the cavity 126 of the bellows 122*a* is no longer sealed. Thus, the force built up in the bellows 122*a* can now be released, allowing the bottom 127*a* of the bellows 122*a* to travel down and expanding the bellows 122*a* again, which results in a suction force that extracts liquid from the cavity 113 of the main body 110 by drawing air in through the air valve 118 in the main body 110. The liquid then travels through the tube 114, the valves 112 and 124, and the tube 123*a*, into the bellows 122*a*.

Note that the action of the bellows 122*a* drawing liquid from the main body 110 commences automatically as soon as the cap portion 120 is coupled to the main body 110 without further action or prompting from the user. In this way, the present invention ensures that the cap portion 120, which can be used separately from the main body 110, is always full when the user detaches the cap portion 120 from the main body 110 again. Thus, the user will never find him/herself in a situation where the cap portion 120 is taken away on holiday, only to discover that it is empty on arrival at the destination.

In addition, although the cap portion 120 can be used for dispensing the liquid product as a separate unit detached from the main body 110, it is likely to be used more often as a combined unit 100 in which the cap portion 120 is coupled to the main body 110 for reasons of convenience and easy storage. In this case, since the tube 114, the valve 112, the valve 124 and the tube 123*a* form a channel between the cavity 113 of the main body 110 and the cavity 126 of the cap portion 120, as the pump mechanism 125 is actuated, liquid is drawn directly from the main body 110, in a manner similar to a conventional spray bottle. Thus, it is more convenient for the user to use the product when there is no need to detach the cap portion 120 from the main body 110, for example, when using the product at home. During such operation the bellows 122*a* of the cap portion 120 is always full, until the main supply is exhausted.

When the cap portion 120 is detached, a spring provided to each of the valves 112 and 124 returns the respective valve to its original position. Since the valves 112 and 124 are being pushed away from their respective cavities 113 and 126, a temporary vacuum/low pressure is created in the cavities, which causes any liquid droplets that may have remained on the tip of each valve to be sucked back through the valves into the cavities, thus leaving both the main body 110 and the cap portion 120 dry.

Figure 4:
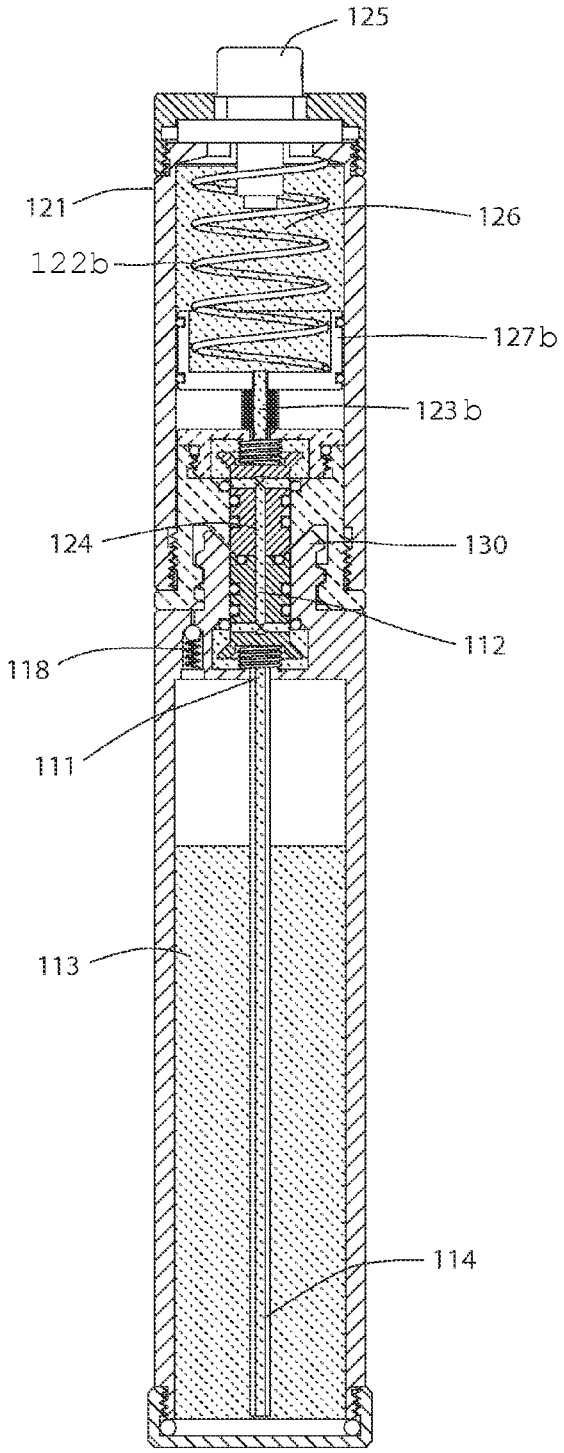
FIG. 4 shows a second embodiment.

FIG. 4 shows a variant of the first embodiment, where the bellows 122*a* (in FIG. 1) in the cap portion 120 is replaced by a piston/cylinder arrangement. The main body 110 of the alternative mode is the same as before and so a description thereof is omitted.

Figure 5:
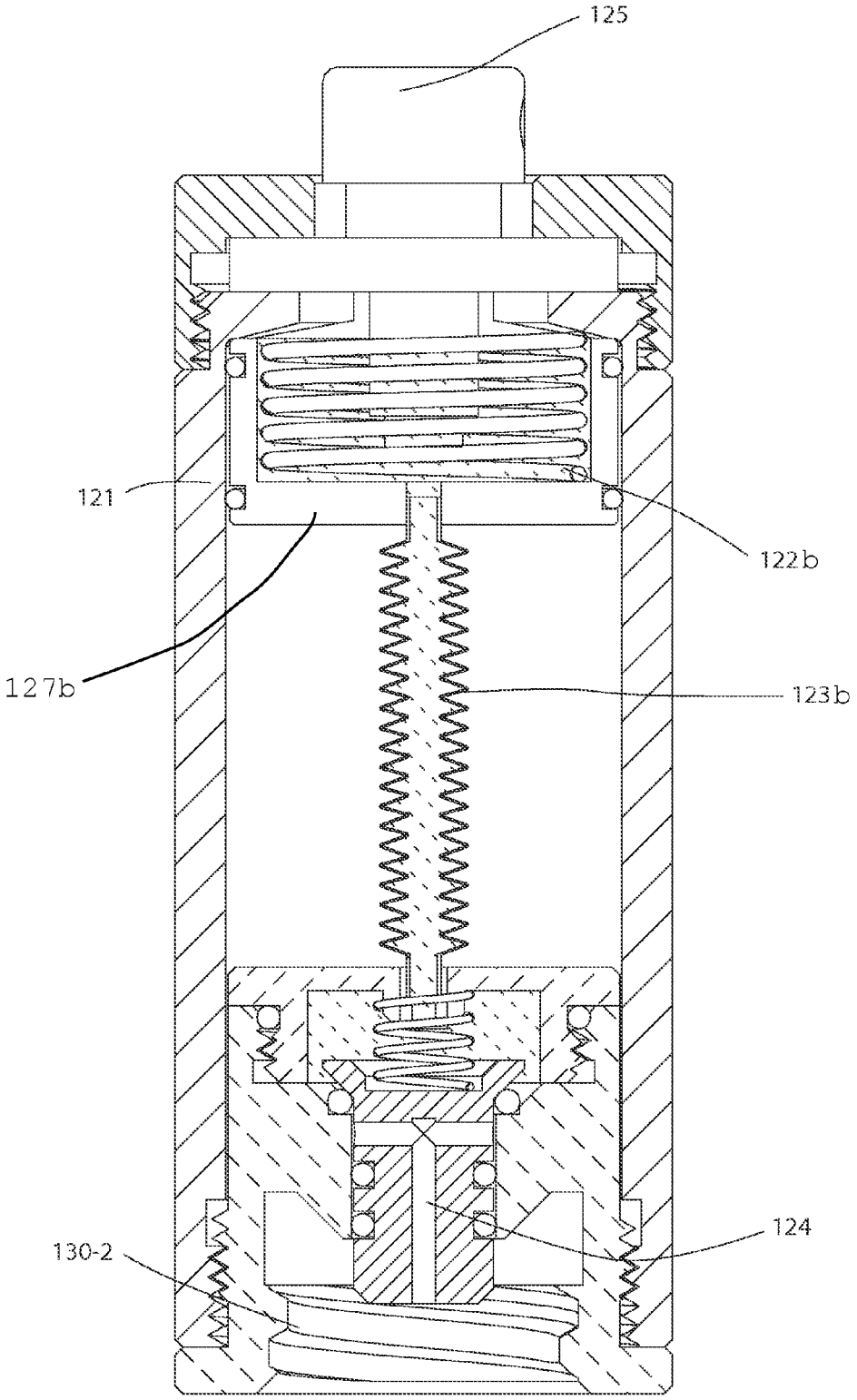
FIG. 5 shows the cap portion of the container system of FIG. 4.

A cavity 126, shown in FIG. 5, in which liquid is confined, is defined by a casing 121 and a piston 127*b*. There are two openings into the cavity 126—a dispense opening at the top which is sealed by a pump mechanism 125, and a refill opening in the piston 127*b*. A valve assembly, including an extensible tube of bellows 123*b* and a valve 124, seals the refill opening in the piston 127*b*, and provides a channel into the cavity 113 of the main body 110 as described above.

The piston 127*b*, sealed against the wall of the casing 121 by one or more O-rings, can slide freely along the wall of the casing 121, expanding or contracting the cavity 126. A spring 122*b* is placed inside the cavity 126 against the top of the casing 121 and the piston 127*b*. When liquid is expelled from the cavity 126 by compressing the pump 125, the piston 127*b* is pushed upwards, diminishing the cavity 126 under atmospheric pressure. As a result, the bellows 123*b* is stretched and the spring 122*b* is compressed.

When the cap portion 120 is coupled to the main body 110, the valve 112 of the main body 110 and the valve 124 of the cap portion 120 push against each other and force the valves to retreat into their respective cavities, thus opening a channel between the cavity 113 of the main body and the cavity 126 of the cap portion as described above. The force that was built up in the compressed spring 122*b* can be released, pushing the piston 127*b* down and expanding the cavity 126, thus drawing liquid from the main body 110 into the cavity 126 of the cap portion 120. The bellows 123*b* has a sufficiently small diameter that it exerts virtually no force on the piston 127*b* as the piston compresses it.

Here, again, since the tube 114, the valve 112, the valve 124 and the bellows 123*b* formed a channel between the cavity 113 of the main body 110 and the cavity 126 of the cap portion 120, the action of the spring 122*b* always ensures that the cavity 126 is always expanded to its maximum volume. When used as a combined unit 100, liquid is drawn directly from the main body 110 as the pump mechanism 125 is actuated, ensuring that the cap portion 120 is always full when coupled to the main body 110.

Figure 6A:
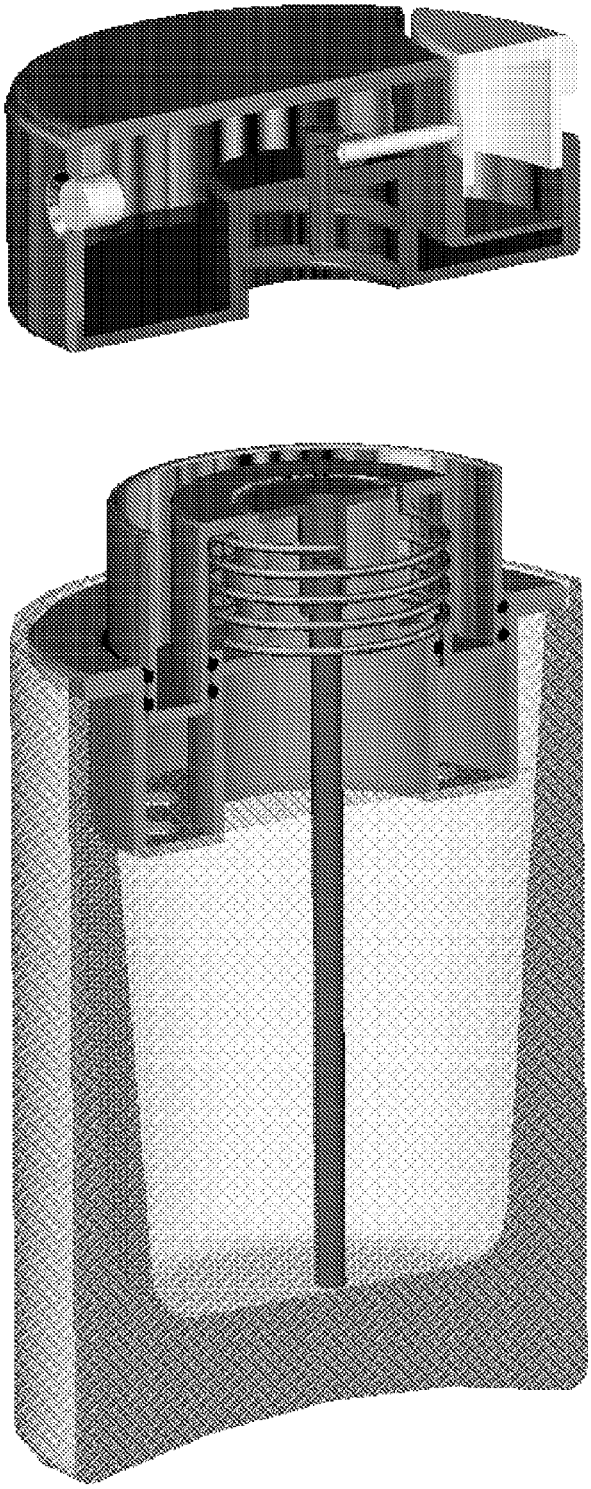
FIG. 6A shows a container system representing a third embodiment of the present invention, in section.
Figure 6B:
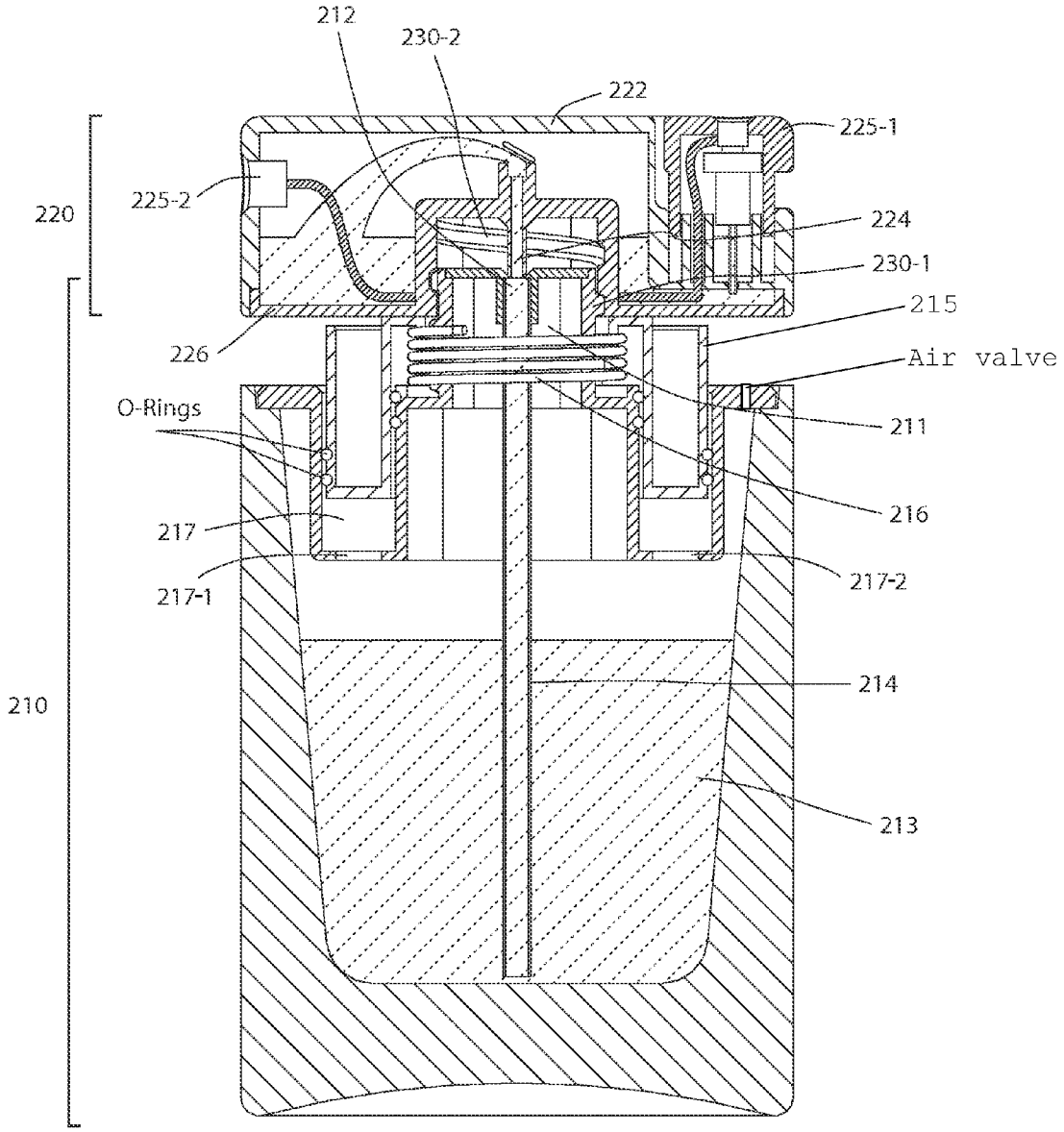
FIG. 6B shows a line drawing of the container system of FIG. 6A.

A third embodiment of the present invention is shown in FIGS. 6A and 6B as a bottle 200, comprising a main body 210 and a cap portion 220, which can be detachably secured to the main body 210 by means of a screw mechanism 230-1 and 230-2. This embodiment can be said to be of a second type, where the moving member or cavity wall is in the main (parent) container rather than the child container.

Figure 7:
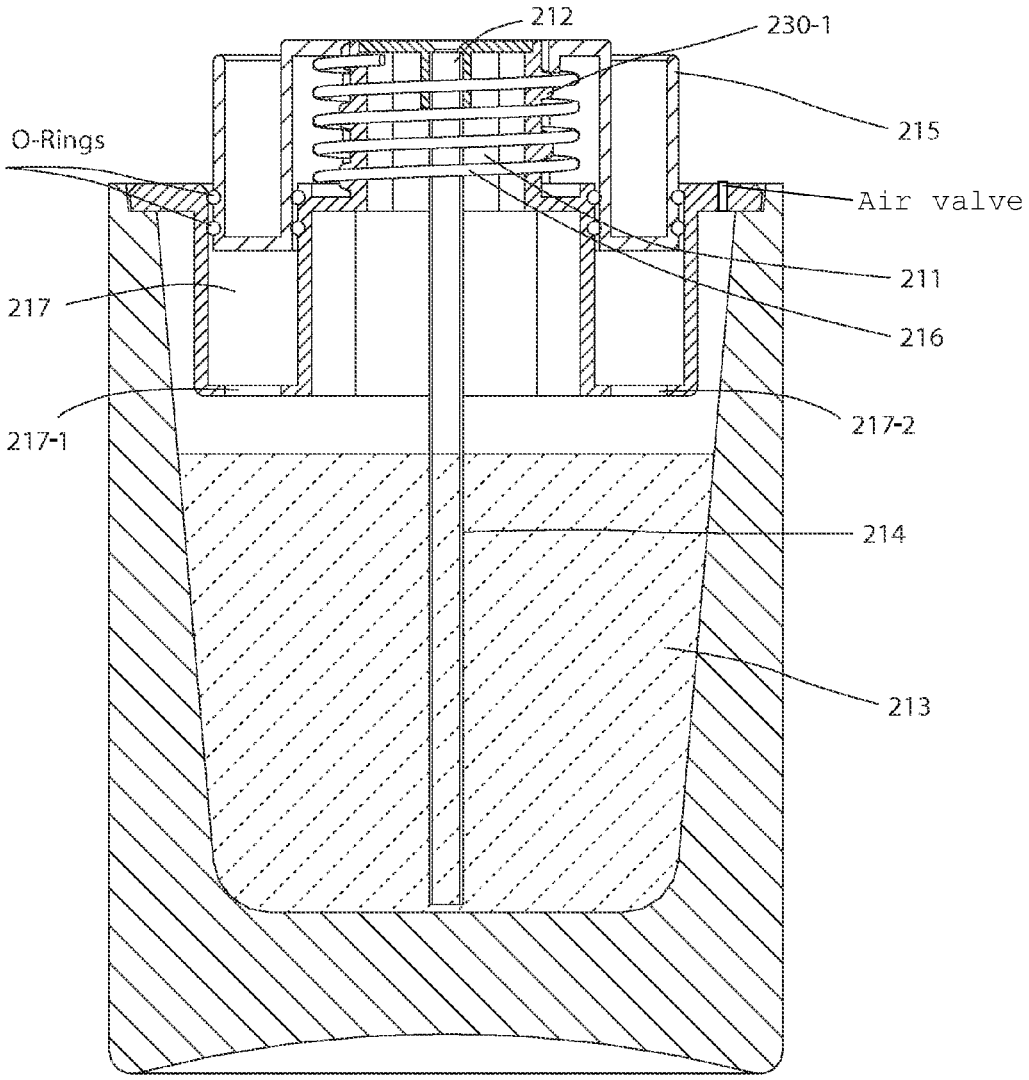
FIG. 7 shows the main body of the container system of FIG. 6B.

The main body 210, being a reservoir for the main quantity of liquid, shown in FIG. 7, has a neck with an opening (supply opening) 211, sealed by a valve 212 not shown in detail. The neck is surrounded by an annular cylinder (compression chamber) 217 having through-holes 217-1 and 217-2 that open into a cavity 213. A movable part in the form of a piston 215 is fitted into the cylinder 217, spring-loaded upwards by a spring 216 surround the neck, and O-rings are placed around the piston 215 to seal any gaps between the piston 215 and the cylinder 217.

As in previous embodiments, the valve 212 holds a tube 214, which extends along the length of the main body 210. Liquid is confined in the sealed cavity 213, and the valve 212 and the tube 214 form a valve assembly that provides a passage for liquid to be extracted from the cavity 213 along the tube 214 through the valve 212 to the outside of the main body 210.

In the separated state shown, the piston 215 is biased to the top of the cylinder 217 by the spring 216 at the level of the valve 212. The piston 215, the spring 216 and the cylinder 217 form an actuator assembly, which encircles the opening 211.

Figure 8:
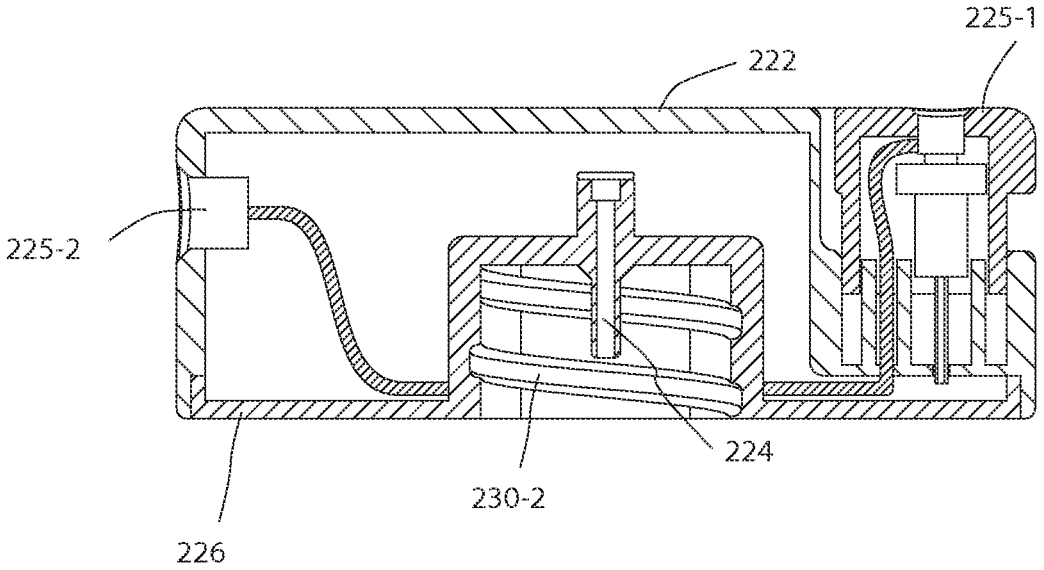
FIG. 8 shows the cap portion of the container system of FIG. 6B.

FIG. 8 shows the corresponding cap portion 220, which is formed as a rigid compartment 222. The compartment 222 has a first opening (refill opening) sealed by a one-way valve 224, a pump mechanism 225-1 is arranged in a conventional way to spray liquid from the cap portion 220 through a nozzle 225-2. The compartment 222 forms a cavity 226 for confining a liquid. The compartment 222 has a recess which forms a screw-threaded recess 230-2 at the bottom end of the cap portion 220 forming part of a securing mechanism.

When the cap portion 220 is placed on the main body 210, the screw-threaded recess 230-2 at the bottom of the cap portion 220 can be screwed onto the screw 230-1 on the neck of the bottle, thus forcing the piston 215 into the cylinder 217, while holding the cap portion 220 on the main body 210.

The valve 224 is situated in the centre of the screw-threaded recess 230-2, and extends as a tube from the cavity 226 into the hollow of the screw-threaded recess 230-2. As the cap portion 220 is screwed onto the main body 210, the valve or tube 224 is inserted into the valve assembly 212 of the main body 210, forming a sealed channel between the cavity 213 of the main body 210 and the cavity 226 of the cap portion 220.

The action of the piston 215 as it is pushed down compresses the air or liquid inside the cylinder 217, and the pressurised air or liquid pushes into the cavity 213 of the main body 210 through the through-holes 217-1 and 217-2, thus increasing the pressure in the cavity 213. The increase in pressure in the cavity 213 of the main body 210 forces liquid up the tube 214, through the valves 212 and 224, and into the cavity 226 of the cap portion 220.

Here, the action of engaging the locking mechanism 230-1, 230-2 always results in the piston 215 being pushed into the cylinder 217, and so the act of coupling the cap portion 220 to the main body 210 ensures that the cavity 226 is always filled to its maximum volume.

In order to ensure that the cap portion 220 is not overfilled when it is being coupled to the main body 210 while filled or partly filled with liquid, the main body 210 is provided with an air valve, which is configured to seal an air vent if the pressure in the cavity 213 is at a normal level at which liquid is pushed into the cap portion 220 when it is not full, but allow air out of the cavity 213 if the pressure increases as a result the cap portion 220 being full, so that the risk of spillage and/or damaging either container is eliminated. Moreover, the same air valve (alternatively a second air valve) is configured to allow air into the cavity 213 as the piston 215 is pushed out of the cylinder 217 by the spring 216, so as to restore the cavity 213 to normal atmospheric pressure.

The piston 215 constitutes the moving part that urges liquid from the parent container to the child container, though variants, e.g. membrane arrangements, are conceivable. The piston 215 can be regarded as part of the wall of the cavity 213.

Again, the tube 214, the valve 212 and the valve 224 form a channel between the cavity 213 of the main body 210 and the cavity 226 of the cap portion 220, such that when the device is used as a combined unit 200, liquid is drawn directly from the main body 210 as the pump mechanism 225 is actuated. As explained in the previous embodiment, this characteristics ensures that the cap portion 220 is always full, or at least filled with one cylinder's worth of liquid, when coupled to the main body 210.

One advantage of piston-type arrangements is that the parts can be made of non-reactive metal, which allows the resulting container to store corrosive liquids. The disadvantage of such piston-type arrangements is the increased manufacturing accuracy and the number of parts (therefore costs) required. In comparison, a bellows can be made out of plastic, and does not demand a high level of precision.

In the embodiments described above, the main body of the container system has not been shown or described as a stand-alone dispenser. However, it should be apparent to those of ordinary skill in the art that, if it is desirable to dispense liquid from the main body separately from the cap portion, for example if the cap portion is misplaced, liquid can be dispensed from the main body by dabbing, if the opening in the main body is not sealed by a valve, or by pushing the valve down, or coupling the valve with a conventional pump, or any other suitable means.

Figure 9:
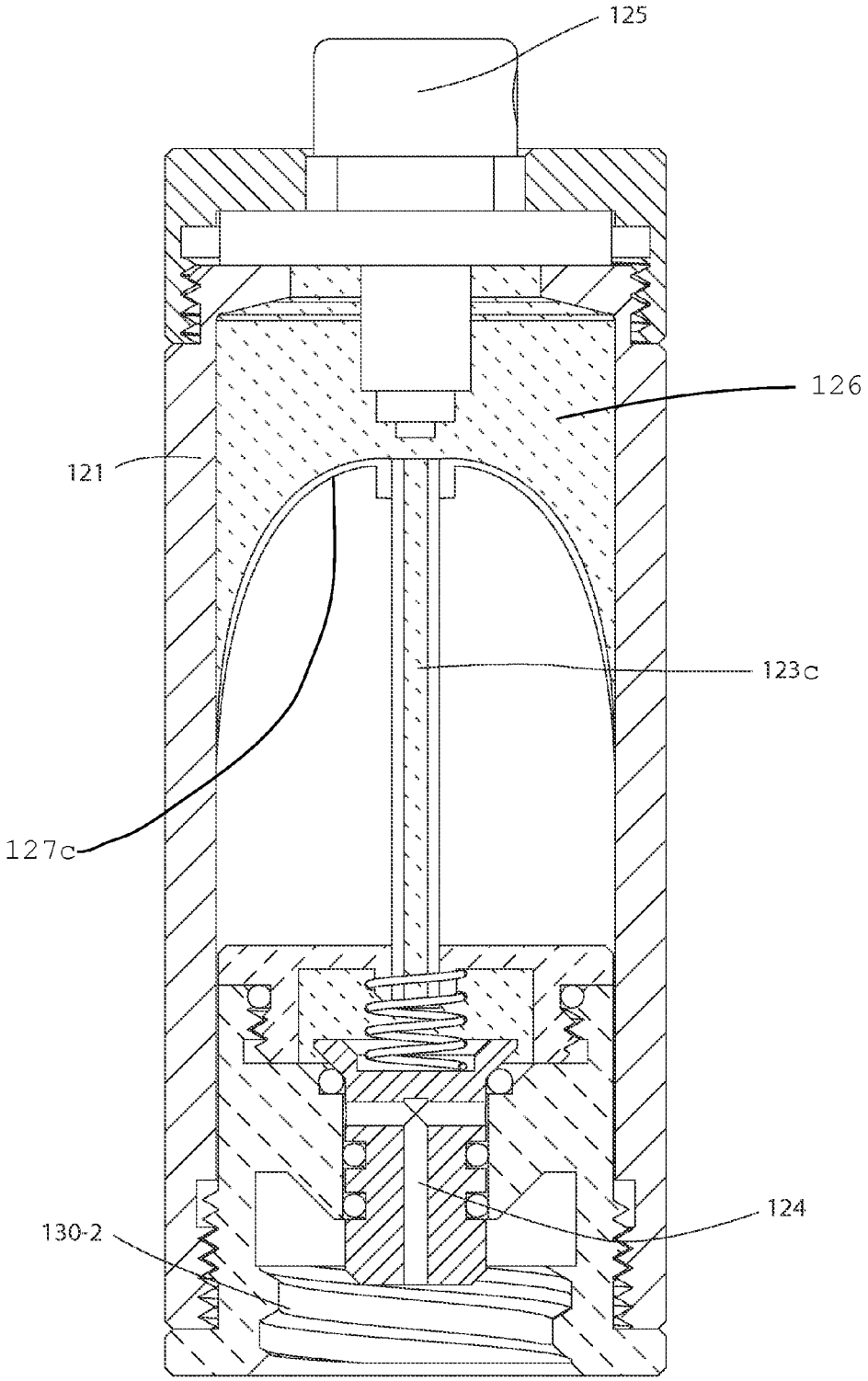
FIG. 9 shows the cap portion of a container system representing a fourth embodiment.

A further variant to the embodiment of the first type is shown in FIG. 9, where an elastic diaphragm 127*c* is attached to the inner wall of the casing 121 of the cap portion 120. The diaphragm defines a cavity 126 where liquid is confined, and the cavity 126 is sealed at one end by a valve 124 and at the other end by a pump 125. The diaphragm 127*c* is sealed around a central axial tube or needle 123*c* conducting liquid from the base region of the cap, at the valve, to the upper region. As liquid is expelled from the cavity 126 by the pump 125, the diaphragm 127*c* is pushed up into the cavity 126 under atmospheric pressure, thus stretching it. When the cap portion 120 is coupled to the main body 110 of the first embodiment, the valves 124 and 112 provide a sealed channel for liquid to travel freely between the cavity 113 of the main body and the cavity 126 of the cap portion 120, allowing the diaphragm 127*c* to release the stored elastic force, drawing liquid into the cavity 126.

For simplicity, the present invention has been described in the context of a container system with a main body and a cap portion. However, those of ordinary skill in the art will appreciate that the present invention can be implemented in many other ways. For example, the bellows 122*a* or the spring 122*b* and piston 127*b* in the first and second embodiments may be replaced by any suitable restoring means. The main body of the container system is not necessarily a rigid body, the cap portion can instead be an independent refillable container, for instance one that the consumer refills in a shop, and the dispensing mechanism may not be a spray pump, may be a squirt pump, foam dispenser, or any other suitable dispensing mechanism.

Moreover, in the first and second embodiments, although desirable, it is not necessary for the main body 110 to have a valve 112 to seal the supply opening 111; the valve 124 of the cap portion 120 may be opened by other means such as a simple protrusion of the main body 110. However, the valve enables the main body to be used as a stand-alone "dabber". A separate spray head can however be provided for the main body if desired. Similarly, the air vent in the main body 110 is not necessarily sealed by the air valve 118, although without an air valve there is a risk of leakage and/or evaporation of the liquid within.

The main body may be flexible, such as a sealed collapsible plastic bag, which can be implemented as a closed system. In this case, as the liquid content is being extracted from the main body, no air is let in to replace the volume of the extracted liquid; consequently the main body collapses under atmospheric pressure. This can be used as a cost-saving option for providing spill-free refill of a liquid product such as liquid soap.

The main body and the refillable portion do not necessarily form a single unit, and can be two independent containers. For example, the refillable portion can be a stand-alone consumer product such as luxury moisturiser, and the main body can be kept at specialist shops where the owner of a refillable portion may purchase refill.

Other delivery systems may be used in the refillable portion to allow automatic or actuated slow release or shot release of the content, for example in place of dishwasher tablets.

Figure 10:
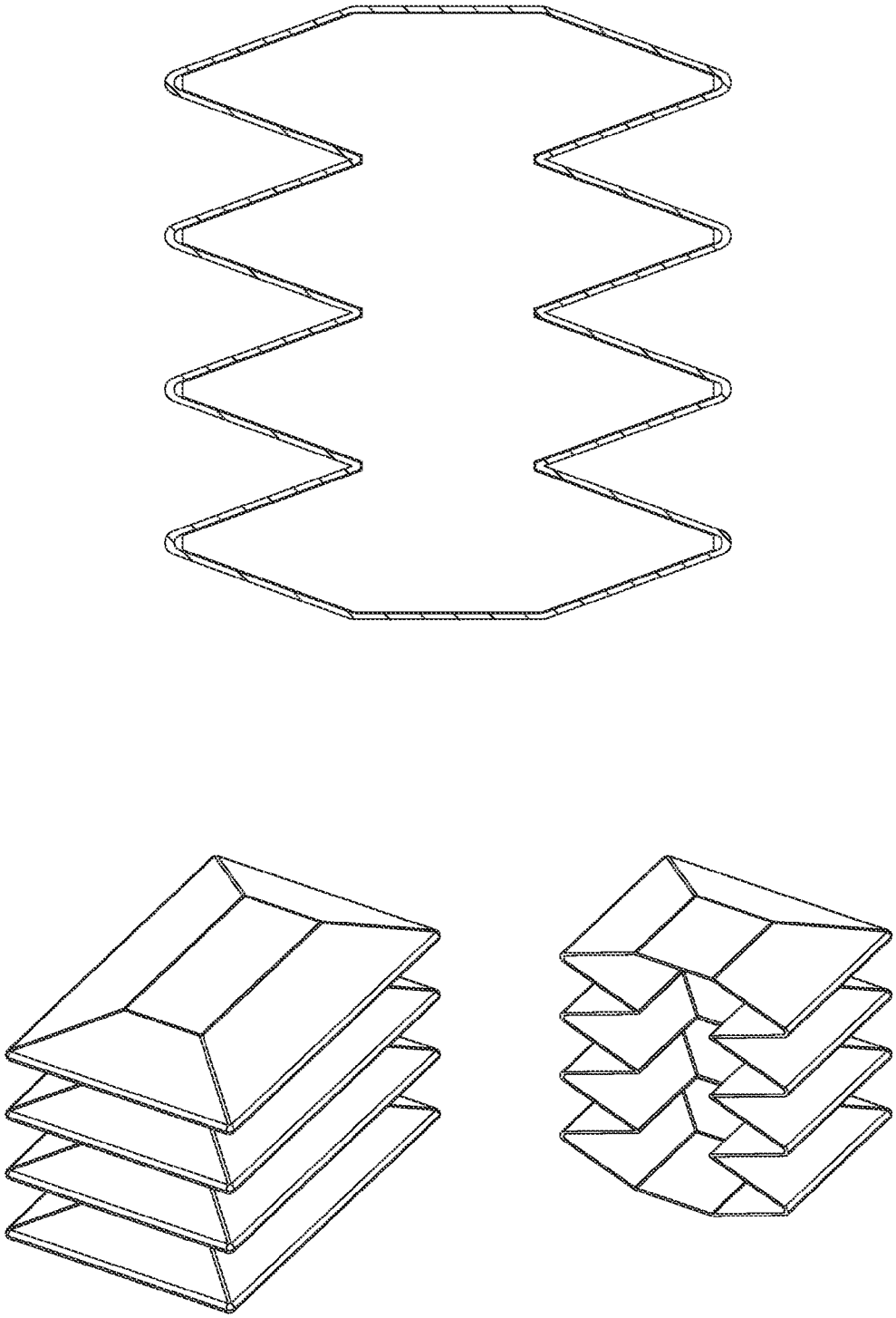
FIG. 10 shows a rectangular shape bellows.

Note also that a container system in accordance with the present invention is not restricted to cylindrical shapes, but can be made into any desirable shape. FIG. 10 shows an example of a bellows of rectangular shape that can be used with a rectangular shape cap portion. For aesthetic reasons the parent container would correspond.

The present invention thus provides a two-part liquid container system for containing and dispensing a liquid product, which comprises a dispensing container that can be used as a single combined unit with a supply container during normal use, but can also be used separately from the supply container to carry a small amount of the liquid product around. The present invention provides an additional convenience for the consumer in that the dispensing container is always full when it is being detached from the supply container, as long as the supply container is not empty. Moreover, when the liquid product runs out, only the supply container is required to be replaced while the dispensing container, often more expensive to manufacture, can be retained. In this way, both the consumer and the manufacturer can save costs by conserving raw materials in the manufacturing process, with an additional advantage to the manufacturer or brand owner of the product of promoting brand loyalty by encouraging the consumer to continually purchase replacements for emptied supply containers.

The invention claimed is:

1. A container system for liquids, including a parent container and a child container, in which:

the parent container provides a first cavity for confining a liquid, and is configured to couple detachably to the child container for refilling the child container through a supply opening in the parent container, and the child container provides a second cavity for confining a liquid, and comprises a dispensing mechanism for dispensing liquid from the second cavity, and a fluid transfer assembly for controlling liquid flow into the child container through a refill opening, forming a channel between the first cavity and the second cavity to allow liquid flow when the parent container is coupled to the child container;

wherein the container system includes a movable part which, in one direction of travel, urges liquid from the parent container to the child container, this movement being brought about as a consequence of the coupling of the child container to the parent container;

wherein as soon as the child container is connected to the parent container, the consequent movement of the movable part automatically draws a sufficient amount of liquid from the first cavity into the second cavity to refill the child container for further use; and a securing mechanism for the detachable coupling and securing of the child container to the parent, so that the dispensing mechanism of the child container is operable to dispense liquid from the parent while the child container is secured to the parent container.

2. A container system according to claim 1, wherein the child container contains the movable part, and further comprises a restoring means for storing a restoring force as liquid is expelled from the second cavity, so that when the child container is disconnected from the parent container dispensing of liquid causes the second cavity to contract, and, when the parent container and the child container are coupled together again, the restoring means releases the restoring force so as to expand the second cavity to the original state, thereby drawing liquid from the first cavity into the second cavity.

3. The container system according to claim 1, wherein:

the fluid transfer assembly includes a first valve assembly that seals the refill opening when the containers are separated, wherein the child container further comprises a restoring means for storing a restoring force as liquid is expelled from the second cavity, such that, when the child container is separated from the parent container, dispensing of liquid causes the second cavity to contract, and when the parent container and the child container are coupled together again, the restoring means releases the restoring force so as to expand the second cavity to the original state, thereby drawing liquid from the first cavity into the second cavity.

4. A container system according to claim 2, wherein the second cavity is defined by a bellows.

5. A container system according to claim 4, wherein the bellows that defines the second cavity is resilient, so as itself to constitute the restoring means, and the bellows is compressed under atmospheric pressure when liquid is expelled from the second cavity by the dispensing mechanism.

6. A container system according to claim 2, wherein the second cavity is defined by a piston.

7. A container system according to claim 2, wherein the restoring means is a spring, which is compressed under atmospheric pressure when liquid is expelled from the second cavity by the dispensing mechanism.

8. A container system according to claim 2, wherein the second cavity is defined by an elastic diaphragm that stretches across the child container, which itself constitutes the movable part and the restoring means, the diaphragm is arranged to store energy as it is being pushed into the second cavity under atmospheric pressure while liquid is expelled from the second cavity by the dispensing mechanism, and releases the stored energy by expanding the second cavity when the parent container is coupled to the child container, thereby drawing liquid from the first cavity into the second cavity.

9. A container system according to claim 2, wherein the fluid transfer assembly includes a valve effective to seal the child container when the two containers are separated.

10. A container system according to claim 9, further including an elongate connecting means between the valve and the second cavity.

11. A container system according to claim 10, wherein the connecting means is a flexible tube fixed at one end to the valve and at the other to the movable part.

12. A container system according to claim 11, wherein the flexible tube is a connection bellows.

13. A container system according to claim 10, wherein the connecting means is a substantially rigid tube slidably coupled to the movable part.

14. A container system according to claim 3, wherein the parent container further comprises a second valve assembly for sealing the supply opening.

15. A container system according to claim 14, wherein the valve assemblies resiliently protrude from their respective containers, and the coupling of the parent container and the child container causes the first valve assembly and the second valve assembly to retreat into their respective containers until the containers are decoupled.

16. A container system according to claim 1, wherein Previously presented parent container comprises the movable part, and which is a part of an actuator assembly for pressurizing the first cavity through the action of coupling the parent container and the child container, such that coupling the parent container with the child container engages the actuator assembly and drives liquid from the first cavity into the second cavity.

17. A container system according to claim 16, wherein the actuator assembly comprises a piston and a compression chamber, the compression chamber having one or more through-holes into the sealed first cavity allowing air or liquid from the first cavity into the compression chamber, and the first cavity is pressurized by pushing the piston into the compression chamber.

18. A container system according to claim 17, wherein the actuator assembly further comprises a spring for returning the piston to a suspended position above the compression chamber.

19. A container system according to claim 18, wherein the actuator assembly surrounds the supply opening.

20. A container system according to claim 1, wherein the parent container has an air hole to enable liquid to be drawn from the first cavity into the second cavity by drawing air into the first cavity through the air hole.

21. A container system according to claim 1, wherein, when the child container is coupled to the parent container, liquid is dispensed by the dispensing mechanism drawing liquid from the first cavity without causing the second cavity to collapse.

* * * * *